US010218102B2

(12) United States Patent
Watanabe et al.

(10) Patent No.: US 10,218,102 B2
(45) Date of Patent: Feb. 26, 2019

(54) TERMINAL FITTING AND CONNECTOR

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Hajime Watanabe, Yokkaichi (JP); Yoshifumi Saka, Yokkaichi (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/770,429

(22) PCT Filed: Oct. 18, 2016

(86) PCT No.: PCT/JP2016/080868
§ 371 (c)(1),
(2) Date: Apr. 23, 2018

(87) PCT Pub. No.: WO2017/077856
PCT Pub. Date: May 11, 2017

(65) Prior Publication Data

US 2018/0316110 A1 Nov. 1, 2018

(30) Foreign Application Priority Data

Nov. 6, 2015 (JP) ..... 2015-218753

(51) Int. Cl.
*H01R 13/03* (2006.01)
*C25D 7/00* (2006.01)
(Continued)

(52) U.S. Cl.
CPC ..... *H01R 13/03* (2013.01); *C25D 5/12* (2013.01); *C25D 5/505* (2013.01); *C25D 7/00* (2013.01); *H01R 43/16* (2013.01); *H01R 12/58* (2013.01)

(58) Field of Classification Search
CPC ..... H01R 13/03
See application file for complete search history.

(56) References Cited

U.S. PATENT DOCUMENTS 10,047,448 B2 * 8/2018 Kato ..... C25D 5/12
2012/0064365 A1 * 3/2012 Takayanagi ..... B22F 7/04 428/648

(Continued)

FOREIGN PATENT DOCUMENTS

JP 2003147579 A 5/2003
JP 2015093999 A 8/2015

(Continued)

OTHER PUBLICATIONS

International Search Report for Application No. PCT/JP2016/080868 dated Jan. 24, 2017; 5 pages.

*Primary Examiner* — Ross N Gushi
(74) *Attorney, Agent, or Firm* — Reising Ethington, P.C.

(57) ABSTRACT

A terminal fitting that can reduce the terminal insertion force and can suppress surface oxidation of a plating film, even if the terminal fitting is exposed to a hot and humid environment, and a connector that uses the terminal fitting. The terminal fitting includes a metal base material, and the plating film. The plating film includes a Ni foundation layer, an outermost layer exposed at the outermost surface, and a (Continued)

$Ni_3Sn_4$ layer formed between the Ni foundation layer and the outermost layer. The outermost layer includes a Sn parent phase, and intermetallic compound that is dispersed in the Sn parent phase, and is made of $(Ni_{0.4}Pd_{0.6})Sn_4$. The intermetallic compound protrudes from the lower side of the outermost layer to the $Ni_3Sn_4$ layer side, and is partially buried in the $Ni_3Sn_4$ layer. A connector includes the terminal fitting, and a housing that holds the terminal fitting.

6 Claims, 12 Drawing Sheets

(51) Int. Cl.

| | |
|---|---|
| ***C25D 5/50*** | (2006.01) |
| ***H01R 43/16*** | (2006.01) |
| ***C25D 5/12*** | (2006.01) |
| *H01R 12/58* | (2011.01) |

(56) References Cited

U.S. PATENT DOCUMENTS

2012/0288724 A1* 11/2012 Ogawa ..... C23C 26/00 428/457
2014/0004373 A1* 1/2014 Taninouchi ..... H01B 1/026 428/573
2014/0308540 A1* 10/2014 Chou ..... H01R 13/03 428/647
2015/0056466 A1* 2/2015 Kato ..... C23C 28/021 428/647
2015/0133005 A1 5/2015 Saka et al.
2015/0184302 A1* 7/2015 Inoue ..... C25D 5/12 428/607
2015/0213918 A1* 7/2015 Shibuya ..... C23C 28/021 439/493
2015/0262947 A1* 9/2015 Shibata ..... H01L 24/05 257/766
2016/0078976 A1* 3/2016 Chou ..... H01H 1/0231 428/647
2016/0240950 A1 8/2016 Watanabe et al.
2016/0268709 A1* 9/2016 Zeigmeister ..... H01R 12/585

FOREIGN PATENT DOCUMENTS

JP WO2015151959 A 10/2015
WO WO2013168764 A 11/2013
WO WO2015068572 A 5/2015

* cited by examiner

TERMINAL FITTING AND CONNECTOR

CROSS REFERENCE TO RELATED APPLICATIONS

This application claims the priority of Japanese patent application JP2015-218753 filed on Nov. 6, 2015, the entire contents of which are incorporated herein.

TECHNICAL FIELD

The present invention relates to a terminal fitting and a connector.

BACKGROUND ART

As terminal fittings for use in connection of an electric circuit, terminal fittings are known that include a metal base material made of a Cu alloy, and a Sn plating film that covers a surface of the metal base material. Terminal fittings include fitting-type terminals that are crimped to ends of electric wires, substrate terminals that are attached to circuit boards, and the like. These terminal fittings may be used alone, or may be used while being attached to connectors.

As a terminal material used for terminal fittings, a terminal material is often used that is obtained by stacking an Ni plating layer, a Cu plating layer, and a Sn plating layer sequentially on a surface of a metal base material made of a Cu alloy (Patent Document 1 JP2003-147579A). However, the terminal fitting disclosed in Patent Document 1 has a high friction coefficient because it has the relatively soft Sn plating layer at its surface, and needs a large terminal insertion force when being connected to a counterpart terminal fitting. Particularly when a terminal fitting is used while being attached to a connector, a multipolar connector that uses a plurality of terminal fittings is often employed, and thus a larger terminal insertion force is likely to be needed as the number of terminal fittings increases.

To reduce the terminal insertion force that is needed when a counterpart terminal fitting is fitted, a terminal fitting in which a Sn—Pd alloy-containing layer that is made of Sn and Pd is formed on a base material made of copper or a copper alloy has also been proposed (Patent Document 2 WO2013/168764A).

SUMMARY

Meanwhile, there may be cases where a terminal fitting is exposed to a hot and humid environment. If, in such a case, surface oxidation of a plating film of the terminal fitting proceeds, then the contact resistance will increase due to the formed oxidized film. Therefore, even if a connector to which such a terminal fitting is applied can reduce the insertion force needed when being connected to a counterpart connector, the connector is likely to corrode and has poor resistance to environment.

The present design was made in view of the above-described circumstances, and it is an object thereof to provide a terminal fitting that needs a less terminal insertion force, and can suppress surface oxidation of a plating film even if the terminal fitting is exposed to a hot and humid environment, and a connector that uses the terminal fitting.

One aspect of the present design relates to a terminal fitting that includes:

a metal base material; and a plating film that covers a surface of the metal base material, wherein the plating film includes a Ni foundation layer that is formed on the surface of the metal base material, an outermost layer that is formed above the Ni foundation layer, and is exposed at an outermost surface, and a $Ni_3Sn_4$ layer that is formed between the Ni foundation layer and the outermost layer, the outermost layer includes a Sn parent phase, and an intermetallic compound that is dispersed in the Sn parent phase, and is made of $(Ni_{0.4}Pd_{0.6})Sn_4$, and the intermetallic compound protrudes from a lower side of the outermost layer to the $Ni_3Sn_4$ layer side, and is partially buried in the $Ni_3Sn_4$ layer.

Another aspect of the present design relates to a connector that includes: the above-described terminal fitting; and a housing that holds the terminal fitting.

In the terminal fitting, the outermost layer of the plating film may include: a Sn parent phase; and an intermetallic compound that is dispersed in the Sn parent phase, and is made of $(Ni_{0.4}Pd_{0.6})Sn_4$. The intermetallic compound is harder than Sn. Therefore, since the outermost layer contains the intermetallic compound, adhesion or scratching of the parent phase of the plating film is unlikely to occur, and the friction coefficient of the outermost surface can be reduced relative to a conventional Sn plating film. Accordingly, the terminal fitting can reduce the terminal insertion force.

Furthermore, even if the intermetallic compound is exposed to a hot and humid environment, an oxidized film is unlikely to grow on the intermetallic compound any more than before it is exposed to the hot and humid environment. Accordingly, the terminal fitting can suppress surface oxidation of the plating film even if it is exposed to a hot and humid environment.

The connector can include the above-described terminal fitting, and thus can reduce the insertion force needed when it is connected to a counterpart connector. Also, the connector is unlikely to corrode even if it is exposed to a hot and humid environment, and is superior in the resistance to environment.

DESCRIPTION OF EMBODIMENTS

Figure 1:
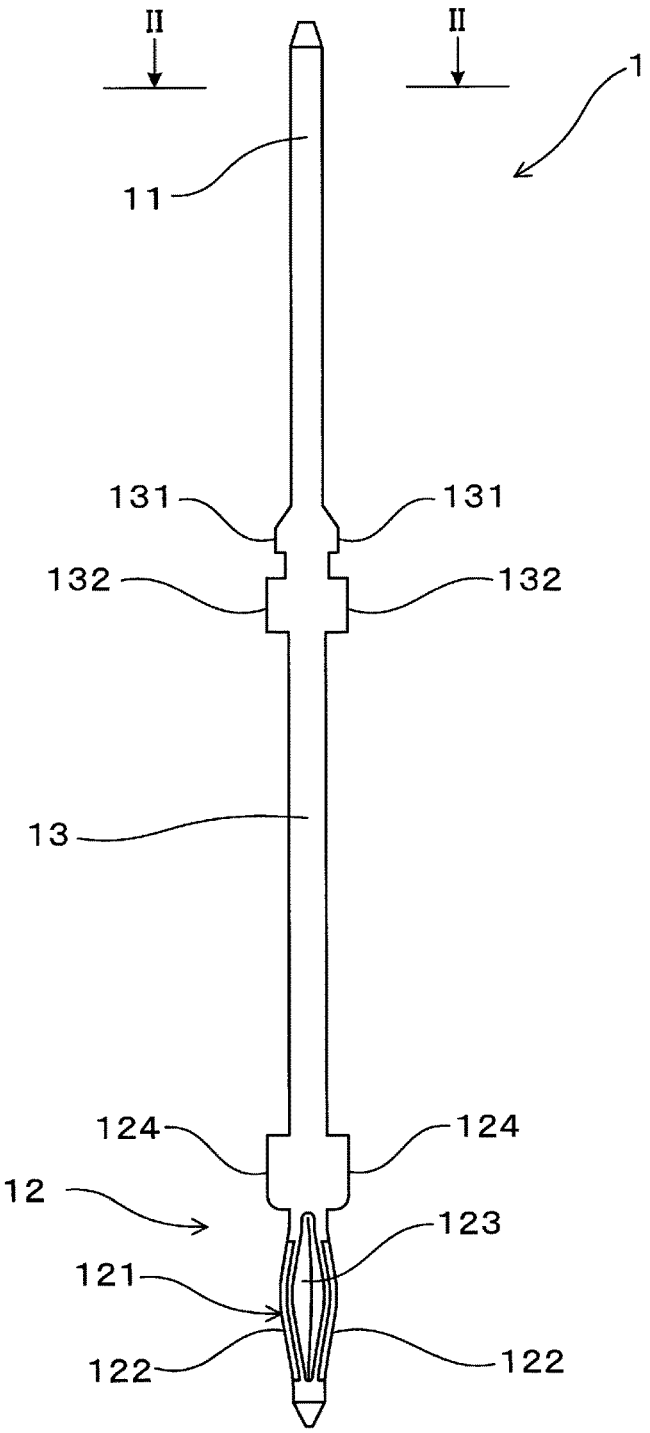
FIG. 1 is a plan view illustrating a terminal fitting according to Embodiment 1.

In the above-described terminal fitting, the metal base material that constitutes the terminal fitting may be selected from various types of conductive metal (including alloys thereof). For example, Cu, Al, Fe, and alloys thereof may be used as the metal base material. Furthermore, the metal base material may be manufactured by subjecting a material such as a wire material or plate material that is made of the above-described metal to cutting processing, punching processing, and pressing processing in a suitable combination.

In the terminal fitting, the plating film may cover the entire surface of the metal base material. Furthermore, the terminal fitting may also include, partially on the surface of the metal base material, a portion that is not covered with the plating film. Examples of the portion may include a fracture surface made due to a punching process. Furthermore, in the terminal fitting, the plating film may also cover a part of the surface of the metal base material. In this case, specific examples may include cases where the plating film covers an electric contact point of the terminal fitting, or the vicinity of the electric contact point.

In the terminal fitting, the plating film includes the outermost layer that is exposed at the outermost surface, and the outermost layer includes an intermetallic compound made of $(Ni_{0.4}Pd_{0.6})Sn_4$.

In the terminal fitting, the plating film includes the Ni foundation layer that is formed on the surface of the metal base material, and the outermost layer that is formed above the Ni foundation layer, and the outermost layer includes a Sn parent phase, and the intermetallic compound that is dispersed in the Sn parent phase. According to this configuration, a terminal fitting is likely to be obtained that can reduce the terminal insertion force, and can suppress surface oxidation of a plating film even if it is exposed to a hot and humid environment.

The Ni foundation layer may be made of Ni plating. The Ni foundation layer may contain, in addition to Ni, a component derived from the Ni plating, for example. Furthermore, the outermost layer is joined to the Ni foundation layer via the $Ni_3Sn_4$ layer, which will be described later. Furthermore, the Sn parent phase of the outermost layer is a phase that contains Sn as a main component. In this context, "main component" refers to the element that has the highest atomic ratio among all elements contained in the Sn parent phase. The Sn parent phase may contain, in addition to Sn serving as the main component, Pd or Ni that is not contained in the intermetallic compound, the element constituting the metal parent phase, a metal oxide other than $(Ni_xPd_{1-x})Sn_4$, an inevitable impurity, and the like.

In the terminal fitting, the intermetallic compound is specifically $(Ni_{0.4}Pd_{0.6})Sn_4$. $(Ni_{0.4}Pd_{0.6})Sn_4$ is superior in chemical stability under a hot and humid environment. Furthermore, $(Ni_{0.4}Pd_{0.6})Sn_4$ is hard such that its Vickers hardness is about 150 Hv, and thus tends to efficiently suppress scratching of the parent phase of the outermost layer such as a Sn parent phase. The intermetallic compound may have an orthorhombic crystal structure, and its main orientation planes may be 040 planes.

In the terminal fitting, the intermetallic compound may have particle diameters in a range from 0.1 to 10 μm. In this case, it is possible to ensure the above-described functions and effects. Furthermore, in this case, it is easy to suppress increase the contact resistance as a result of a component, a chemical compound, or the like that is located below the outermost layer being exposed from the outermost surface, and to ensure the amount of the Sn parent phase of the outermost layer that is needed to ensure appropriate electric connection. The lower limit of the particle diameters of the intermetallic compound is preferably at least 0.2 μm, more preferably at least 0.3 μm, even more preferably at least 0.4 μm, and further preferably at least 0.5 μm. Furthermore, the upper limit of the particle diameters of the intermetallic compound is preferably at most 9 μm, more preferably at most 8 μm, even more preferably at most 7 μm, further preferably at most 6 μm, and yet further preferably at most 5 μm.

Note that the particle diameters of an intermetallic compound are measured in the following manner. The surface of the outermost layer is etched, and only the parent phase of the outermost layer is selectively removed. Since the parent phase is Sn, an aqueous solution that is obtained by dissolving sodium hydroxide and p-nitrophenol in distillated water can be used as an etching solution. Then, the etched surface is observed using a scanning electron microscope at the magnification of 5000×, and one surface image is captured. The largest diameters of individual intermetallic compound particles that have appeared on the captured surface image are measured. The minimum value of the measured largest diameters is defined as the minimum value of the particle diameters of the intermetallic compound. Furthermore, the maximum value of the measured largest diameters is defined as the maximum value of the particle diameters of the intermetallic compound.

In the terminal fitting, the outermost layer may be configured to contain the intermetallic compound that is exposed from the outermost surface of the plating film. In this case, it is possible to reliably reduce the friction coefficient of the outermost surface of the plating film. Furthermore, in this case, it is possible to reliably suppress surface oxidation of the plating film when it is exposed to a hot and humid environment. Specifically, the "intermetallic compound that is exposed from the outermost surface of the plating film" may denote a configuration in which the intermetallic compound is partially exposed from the outermost surface. Furthermore, the parent phase of the outermost layer is exposed as the remaining portion, apart from the intermetallic compound exposed from the outermost surface of the plating film. Note that the outermost layer may also contain an intermetallic compound that is not exposed from the outermost surface of the plating film but is buried in the outermost layer.

The exposed area ratio of the intermetallic compound to the outermost surface of the plating film is preferably at least 10%, more preferably at least 15%, even more preferably at least 20%, further preferably at least 25%, and yet further preferably at least 30%, in view of reducing the friction coefficient of the outermost surface of the plating film, and suppressing surface oxidation of the plating film when it is exposed to a hot and humid environment. Furthermore, the exposed area ratio of the intermetallic compound to the outermost surface of the plating film is preferably at most 90%, more preferably at most 85%, even more preferably at most 80%, further preferably at most 75%, and yet further preferably at most 70%, in view of ensuring the parent phase that is exposed at the outermost surface of the plating film, and achieving appropriate electric connection to a counterpart terminal fitting. Note that the above-described exposed area ratio is obtained in the same manner as the measurement of the particle diameters of the intermetallic compound in which the outermost layer surface, which is the outermost surface of the plating film, is etched, only the parent phase of the outermost layer is selectively removed, and the ratio of the area of the intermetallic compound that is present on the outer surface to the outer surface of the outermost layer with only the parent phase removed is calculated.

In the terminal fitting, the plating film includes the $Ni_3Sn_4$ layer between the Ni foundation layer and the outermost layer. According to this configuration, even if the terminal fitting is exposed to a heat environment, it is possible to suppress an increase in the contact resistance that is caused by $Ni_3Sn_4$ dispersing from the Ni foundation layer toward the outermost surface of the plating film due to the heat. Therefore, according to this configuration, it is easy to realize a terminal fitting in which an oxidized film is unlikely to be formed on the plating film under a hot and humid environment, and that has a low contact resistance. Note that, if the $Ni_3Sn_4$ layer is provided between the Ni foundation layer and the outermost layer, and the lower limit of the particle diameters of the intermetallic compound is in the above-described range, then it is easy to suppress an increase in the contact resistance that is caused by $Ni_3Sn_4$ that is locally grown from the Ni foundation layer being exposed from the outermost surface of the plating film.

The thickness of the $Ni_3Sn_4$ layer may be set to at least 0.4 μm in view of ensuring the above-described effects brought about by the $Ni_3Sn_4$ layer. The thickness of the $Ni_3Sn_4$ layer is preferably at least 0.45 μm, more preferably at least 0.5 μm, and further preferably at least 0.6 μm. The thickness of the $Ni_3Sn_4$ layer is preferably not greater than the thickness of the outermost layer, more preferably not greater than a value obtained by (the thickness of the outermost layer—0.1 μm), in view of reliably suppressing the $Ni_3Sn_4$ layer from being exposed from the outermost surface of the plating film. Note that the thickness of the $Ni_3Sn_4$ layer is measured in the following manner. A cross-section of the plating film is observed using a scanning electron microscope, the obtained observation image is subjected to binarization processing, and the area ratio of the $Ni_3Sn_4$ layer to the sum of the areas of the outermost layer and the $Ni_3Sn_4$ layer is calculated based on the obtained binary image. Based on the result of (the area ratio of the $Ni_3Sn_4$ layer)×(the sum of the layer thicknesses of the outermost layer and the $Ni_3Sn_4$ layer) that was obtained based on the above-described binarization, an average layer thickness of the $Ni_3Sn_4$ layer is calculated. Note that the binarization processing is performed such that the Sn parent phase and the intermetallic compound ($(Ni_{0.4}Pd_{0.6})Sn_4$) of the outermost layer serves as a "bright portion", and the $Ni_3Sn_4$ layer serves as a "dark portion". Furthermore, a threshold of contrast of the binarization processing is set such that the outline of the $Ni_3Sn_4$ in the binary image substantially conforms to the outline of the $Ni_3Sn_4$ in the surface image.

In the terminal fitting, the thickness of the outermost layer may be in the range from 0.1 to 4 μm in view of ensuring the above-described functions and effects. The thickness of the outermost layer is preferably at least 0.3 μm, more preferably at least 0.5 μm, and further preferably at least 0.8 μm. The thickness of the outermost layer is preferably at most 3.5 μm, more preferably at most 3 μm, further preferably at most 2.5 μm, and yet further preferably at most 2 μm, in view of formability of the plating film. Note that the thickness of the outermost layer is measured as a sum of thicknesses of metal of the parent phase (the thickness of Sn since the parent phase metal is Sn), Sn of the intermetallic compound, and Pd of the intermetallic compound, these thicknesses being measured by a fluorescent X-ray coating thickness tester. The measurement is performed with the spot diameter in the layer thickness measurement set to 0.1 mmø or 0.2 mmø, taking into consideration a case where the outermost layer is wavy in an interface portion.

In the terminal fitting, the thickness of the Ni foundation layer is preferably at least 0.1 μm, more preferably at least 0.5 μm, and further preferably at least 1 μm, in view of suppressing dispersion of elements constituting the metal base material, plating adhesiveness, easy formability of the $Ni_3Sn_4$ layer, and the like. The thickness of the Ni foundation layer is preferably at most 4 μm, more preferably at most 3 μm, and further preferably at most 2 μm, in view of maintaining bending workability and the like. Note that the thickness of the Ni foundation layer is a value of the Ni thickness that is measured by a fluorescent X-ray coating thickness tester. The measurement is performed with the spot diameter in the layer thickness measurement set to 0.1 mmø or 0.2 mmø, taking into consideration the case where the Ni foundation layer is wavy in an interface portion.

The terminal fitting may be configured, for example, as a fitting-type terminal or a substrate terminal that has a known shape. The fitting-type terminal may be configured to have, for example, an electric contact point that is brought into contact with a counterpart terminal fitting, and a barrel portion that crimps an electric wire. When the above-described terminal fitting is configured as a fitting-type terminal, providing the plating film at least on the electric contact point can achieve the above-described functions and effects. Furthermore, if at least either one of a fitting-type terminal pair of a male terminal and a female terminal is the terminal fitting including the plating film, then the above-described functions and effects can be obtained, and if both of the pair of terminals are the above-described terminal fittings, then the above-described functions and effects can be obtained sufficiently.

If the terminal fitting is configured as a substrate terminal, then the terminal fitting may be configured to be used while being connected to a circuit board in a state in which the terminal fitting is held by a housing, or may be configured to be used while being connected directly to the circuit board. In the former case, a plurality of terminal fittings are typically held by the housing, and thus it is easy to suppress an increase in the insertion force needed when they are fitted to a counterpart connector, the increase being caused by an increase in the number of the terminal fittings. Therefore, the above-described effect of reducing the insertion force can sufficiently be achieved.

Furthermore, the terminal fitting configured as a substrate terminal includes, as integral portions, a terminal connection portion that is to be electrically connected to a counterpart terminal fitting, a board connection portion that is to be electrically connected to the circuit board, and an intermediate portion that is located between the terminal connection portion and the board connection portion, and it is sufficient that at least the terminal connection portion and the board connection portion are covered with the plating film.

The board connection portion may be configured to include, for example, a press fit portion that is press-fitted into a through hole of the circuit board, and is electrically connected to the circuit board via a conductive portion provided in the through hole.

The above-described connector may be configured to include a plurality of such terminal fittings. In this case, it is possible to efficiently reduce the insertion force that increases with an increase in the number of the terminal fittings.

Note that the above-described configurations can suitably be combined as needed, in order to achieve the foregoing functions and effects.

Embodiments

Hereinafter, the terminal fitting and the connector of embodiments will be described with reference to the drawing. Note that in the description, the same reference signs are given to the same components.

Embodiment 1

The terminal fitting according to Embodiment 1 will be described with reference to FIGS. 1 to 5. As shown in FIGS. 1 to 5, a terminal fitting 1 of the present embodiment includes a metal base material 2, and a plating film 3 that covers a surface of the metal base material 2. The plating film 3 has an outermost layer 31 that is exposed at the outermost surface. The outermost layer 31 includes an intermetallic compound 312.

The plating film 3 includes a Ni foundation layer 321 that is formed on the surface of the metal base material 2, and the outermost layer 31 that is formed above the Ni foundation layer 321, and is exposed at the outermost surface of the plating film 3. The outermost layer 31 includes a Sn parent phase 311, and the intermetallic compound 312 that is dispersed in the Sn parent phase 311.

In the present embodiment, the metal base material 2 is specifically a Cu alloy. Furthermore, the intermetallic compound 312 is made of $(Ni_{0.4}Pd_{0.6})Sn_4$. The particle diameters of the intermetallic compound 312 are set to be in the range from 0.1 to 10 μm. The outermost layer 31 includes the intermetallic compound 312 that is exposed from the outermost surface of the plating film 3, namely, the outer surface of the outermost layer 31. Here, the exposed area ratio of the intermetallic compound 312 to the outermost surface of the plating film 3 is in the range from 10 to 90%, and may specifically be set to 75%, for example.

Figure 2:
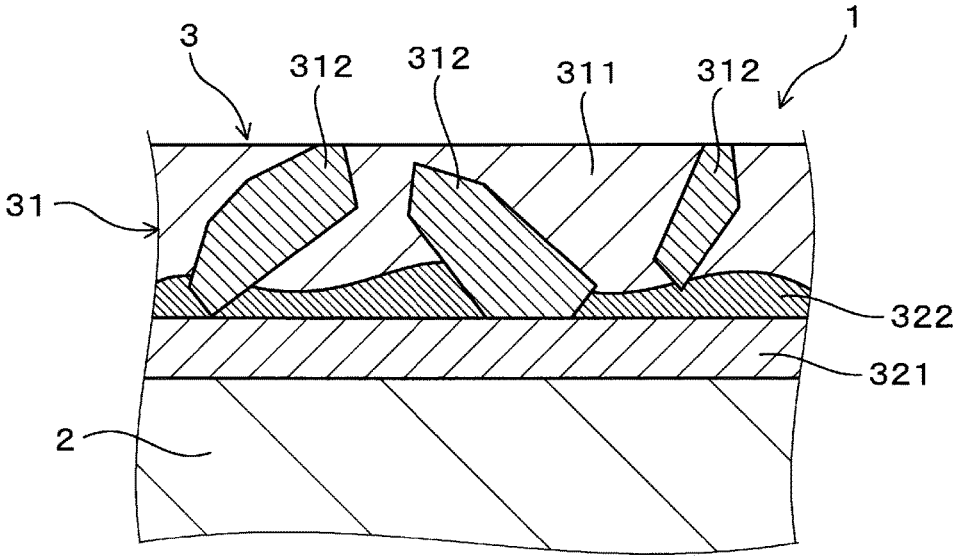
FIG. 2 schematically illustrates a part of a cross-sectional view taken along a line II-II in FIG. 1.

The plating film 3 includes a $Ni_3Sn_4$ layer 322 between the Ni foundation layer 321 and the outermost layer 31. Furthermore, in the terminal fitting 1, as shown in FIG. 2, the intermetallic compound 312 protrudes from the lower side of the outermost layer 31 to the $Ni_3Sn_4$ layer 322 side, and is partially buried in the $Ni_3Sn_4$ layer 322.

Note that in the present embodiment, the thickness of the outermost layer 31 is in the range from 0.1 to 4 μm and may specifically be set to 1 μm for example. Furthermore, the thickness of the Ni foundation layer 321 is in the range from 0.1 to 4 μm and may specifically be set to 1 μm for example. Furthermore, the thickness of the $Ni_3Sn_4$ layer 322 is at least 0.4 μm and may specifically be set to 0.6 μm.

In the present embodiment, the terminal fitting 1 specifically includes, as integral portions, a terminal connection portion 11 that is to be electrically connected to a counterpart terminal fitting (not shown), a board connection portion 12 that is to be electrically connected to a circuit board 5, and an intermediate portion 13 that is located between the terminal connection portion 11 and the board connection portion 12. The terminal fitting 1 includes, at least in the terminal connection portion 11 and the board connection portion 12, the above-described plating film 3 on the metal base material 2. More specifically, the terminal fitting 1 is configured as a press fit terminal. The board connection portion 12 includes a press fit portion 121 that is press-fitted into a through hole 51 of the circuit board 5, and is electrically connected to the circuit board 5 via a conductive portion 52 provided in the through hole 51.

The terminal fitting 1 of the present embodiment can be manufactured in, for example, the following manner.

Figure 3:
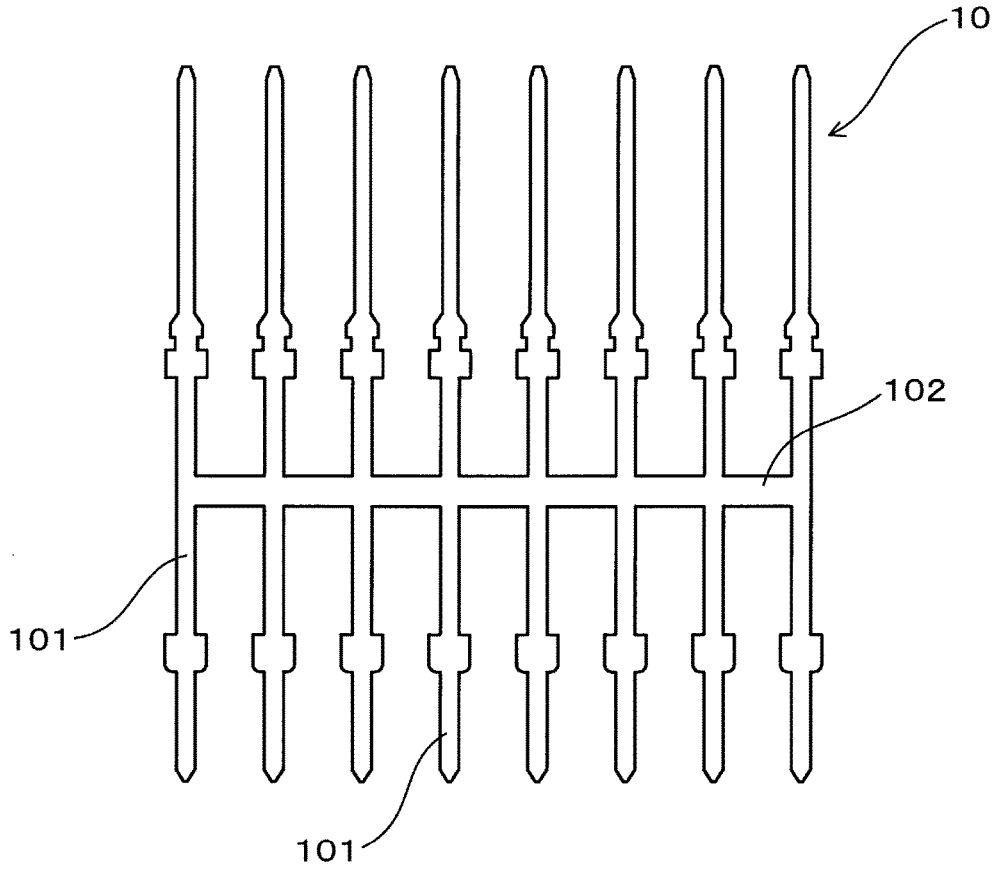
FIG. 3 is a plan view illustrating a terminal intermediate material for use in manufacturing terminal fittings of Embodiment 1.

A plate material made of a Cu alloy is punched by a pressing machine to manufacture a terminal intermediate material 10 shown in FIG. 3. The terminal intermediate material 10 is such that a plurality of rod-like terminal portions 101 are lined up in parallel to each other, and adjacent terminal portions 101 are contiguous to each other via a carrier portion 102. The terminal portions 101, which configure the press fit portions 121, are separated from the carrier portion 102 after being subjected to plating processing, so that the terminal fittings 1 are obtained.

The electric plating processing is performed on the entire surface of the terminal intermediate material 10 to stack a Ni plating film, a Pd plating film, and a Sn plating film sequentially on the surface. The thicknesses of the Ni plating film, the Pd plating film, and the Sn plating film may respectively be selected from the range from 0.1 to 4 μm, the range from 0.001 to 0.1 μm, and the range from 0.1 to 3 μm. Specifically, the thicknesses of the Ni plating film, the Pd plating film, and the Sn plating film may respectively be set to, for example, 1 μm, 0.02 μm, and 1 μm.

After the electric plating processing, the terminal intermediate material 10 is heated and subjected to reflow processing, so that the plating film 3 can be formed. The heating temperature of the reflow processing may be not smaller than the melting point of Sn (230° C.), may specifically be in the range from 230 to 400° C., and may more specifically be 350° C.

After the reflow processing, the terminal intermediate material 10 is subjected to pressing processing, so that the terminal connection portion 11 and the board connection portion 12 are formed on the individual terminal portions 101. Then, punching processing can be performed to separate the terminal portions 101 from the carrier portions 102, so that the terminal fittings 1 are obtained.

Figure 4:
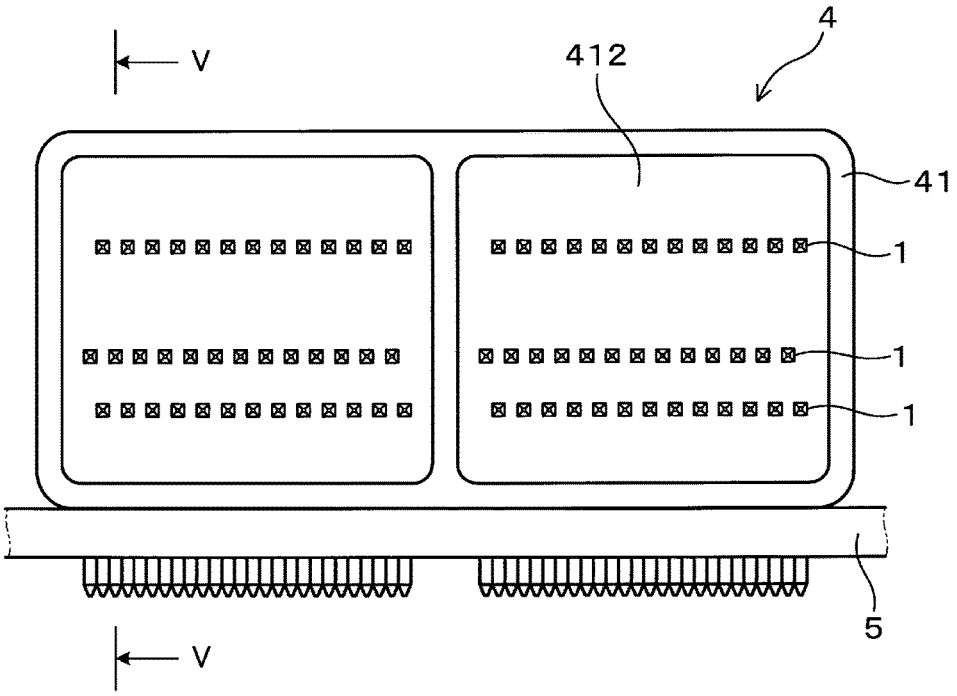
FIG. 4 is a front view illustrating a connector according to Embodiment 1 that is provided with the terminal fittings of Embodiment 1.
Figure 5:
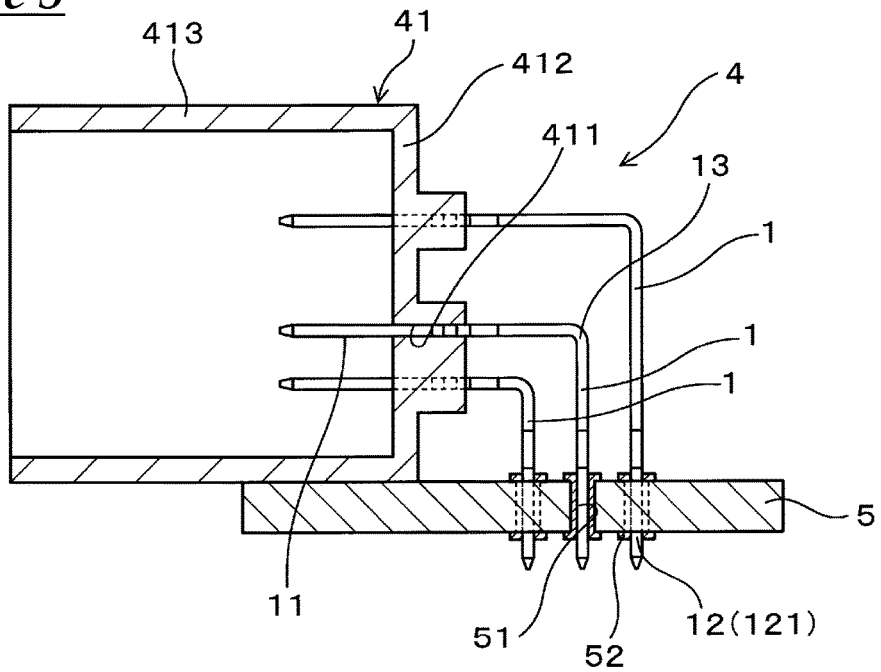
FIG. 5 is a cross-sectional view taken along a line V-V in FIG. 4.

The following will describe the connector of Embodiment 1 with reference to FIGS. 4 and 5. As shown in FIGS. 4 and 5, a connector 4 of the present embodiment includes the above-described terminal fittings 1 of Embodiment 1, and a housing 41 that holds the terminal fittings 1.

In the present embodiment, the connector 4 includes a plurality of terminal fittings 1. The terminal fittings 1 are each bent in an "L" shape in a state while being held by the housing 41. The housing 41 is made of a synthetic resin, and includes, on the front side thereof, a hood portion 413 that accommodates a counterpart connector (not shown) that is fitted thereto, and a rear wall 412 that is formed in the rear of the hood portion 413 integrally therewith. The terminal fittings 1 on the terminal connection portion 11 side are press-fitted into terminal press fit holes 411 that are formed in the rear wall 412 of the housing 41, and are held by the housing 41.

The terminal connection portions 11 are formed in a tab shape, and are each inserted into a tubular fitting portion of a counterpart terminal fitting to form electrical connection thereto. The intermediate portion 13 is provided with, at its end on the terminal connection portion 11 side, a pair of retaining portions 131 and a pair of positioning portions 132 that protrude in the width direction thereof. The retaining portions 131 have tapered edges on their front side so that the terminal fitting 1 on the terminal connection portion 11 side can be press-fitted into the terminal press fit hole 411, and the retaining portions 131 have opposite edges that are raised perpendicularly so that the terminal fitting 1 is retained. Furthermore, the positioning portions 132 have edges on their front side that are raised perpendicularly, so as to be latched with the rim of the terminal press fit hole 411 when the terminal fitting 1 is press-fitted, and thus the terminal fitting 1 is positioned. Furthermore, after having been latched into the terminal press fit hole 411, the intermediate portion 13 is bent in an "L" shape.

Furthermore, the board connection portion 12 includes the press fit portion 121. The press fit portion 121 includes: a pair of contact pieces 122 that bulge out substantially in an arc shape, and whose outer side surfaces come into contact with the conductive portion 52 of the through hole 51; and a thin-wall portion 123 that is provided between the contact pieces 122, and is elastically and plastically deformable. The press fit portion 121 has a tapered front end. The maximum outer diameter of the press fit portion 121 is larger than the inner diameter of the conductive portion 52 of the through hole 51. As a result of the thin-wall portion 123 being pressed in the radial direction while being compressed and deformed, the press fit portion 121 is configured to be press-fitted into the through hole 51, and be electrically connected to the conductive portion 52. Note that the press fit portion 121 is provided with, on its base end side, a pair of jig abutting portions 124 that project in the width direction, and on which a press fitting jig (not shown) is placed when the press fit portion 121 is press-fitted into the through hole 51.

Experimental Examples

Hereinafter, more specific description will be given with reference to experimental examples.

Sample 1 was produced by sequentially forming a Ni plating film (thickness: 1 μm), a Pd plating film (thickness: 0.02 μm), and a Sn plating film (thickness: 1.5 μm) on a surface of a Cu alloy plate material, and then subjecting the resultant to reflow processing at 350° C.

Sample 2 was produced in the same manner as in Sample 1 but using a Pd plating film (thickness: 0.025 μm), and a Sn plating film (thickness: 1.25 μm) instead. Furthermore, Sample 3 was produced in the same manner as in Sample 1 but using a Pd plating film (thickness: 0.03 μm) and a Sn plating film (thickness: 1.0 μm) instead. Note that for comparison, Sample 1C was produced by sequentially forming a Ni plating film (thickness: 1 μm), and a Sn plating film (thickness: 1 μm) on a surface of a Cu alloy plate material, and then subjecting the resultant to reflow processing at 350° C.

Then, cross-sections of Samples 1 to 3 were observed using a scanning electron microscope, and the observation results clearly showed that every plating film includes: the Ni foundation layer arranged on the surface of the Cu alloy serving as a metal base material; and the outermost layer that is arranged above the Ni foundation layer, and is exposed at the outermost surface of the plating film. Furthermore, a $Ni_3Sn_4$ layer that was obtained as a result of a part of the Ni plating film and a part of the Sn plating film being alloyed was arranged between the Ni foundation layer and the outermost layer. Furthermore, a Sn parent phase, and a plurality of particulate materials dispersed in the Sn parent phase were observed in the outermost layer.

Then, XRD analysis was performed to investigate the particulate materials contained in the outermost layers of Samples 1 to 3 in terms of their composition, crystal structure, and the like. Note that the "SmartLab" of Rigaku Corporation was used as an XRD analysis device. Furthermore, the conditions of the XRD analysis were set as follows: used X-ray: Cu tube (point focus); 45 kV; 200 mA; collimator: ø0.3 mm; optical system: two dimensional detector "PILATUS"; measurement method: micro part XRD (wide-angle measurement, 2θ-θ scanning).

Figure 6:
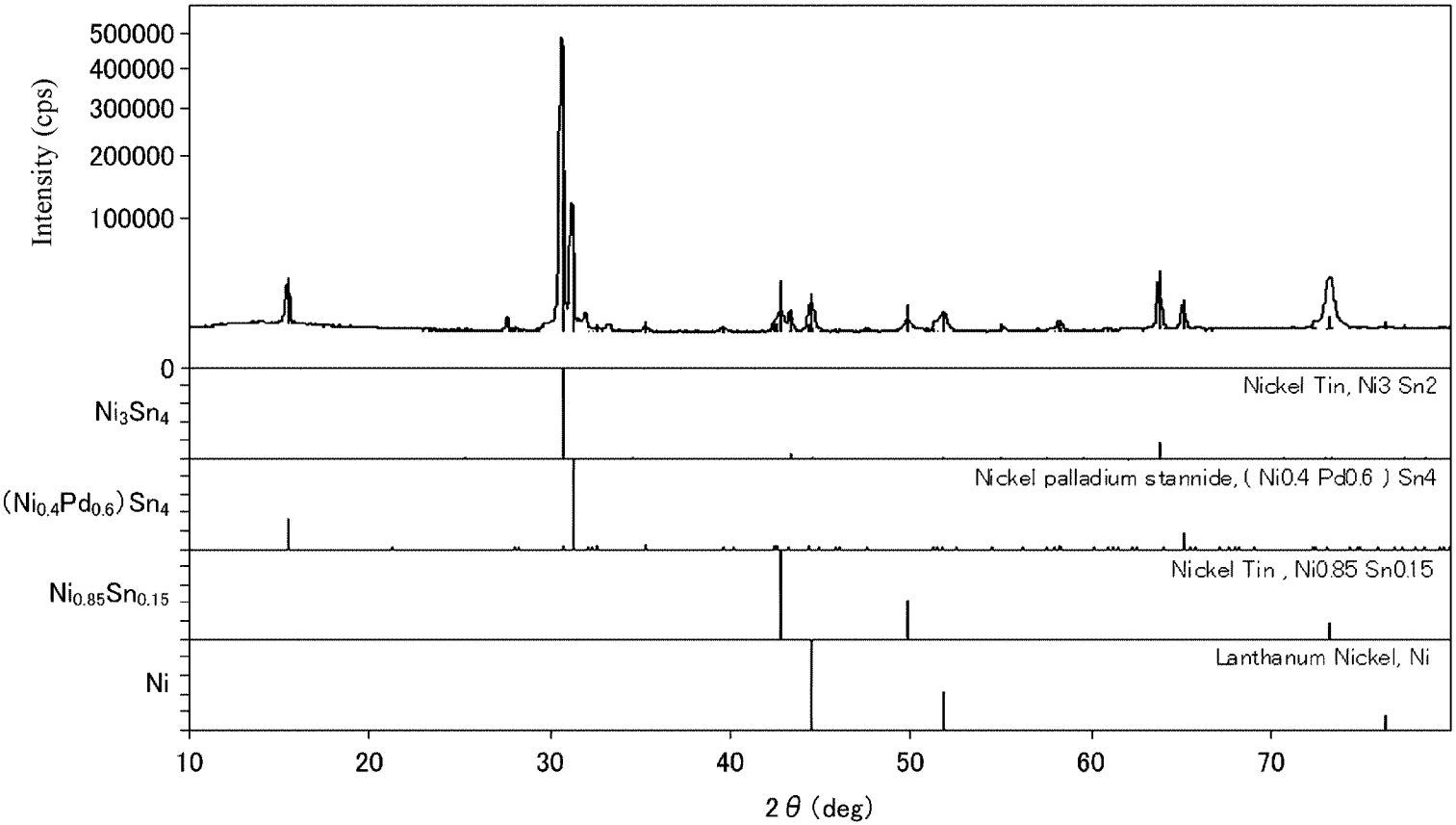
FIG. 6 is a measurement profile that is obtained by XRD analysis of a plating film of Sample 1 that is performed in an experimental example.
Figure 7:
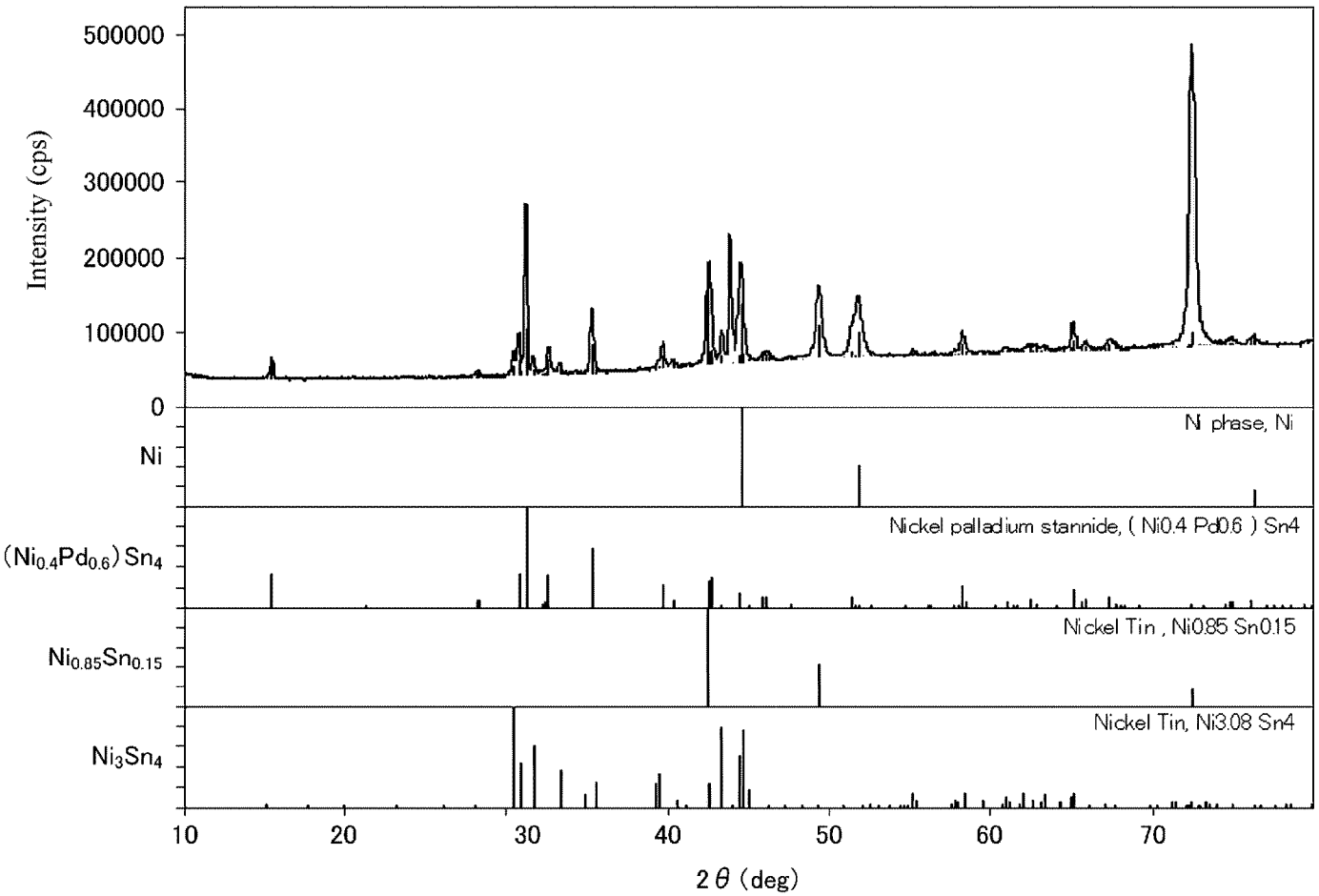
FIG. 7 is a measurement profile that is obtained by XRD analysis of a plating film of Sample 2 that is performed in an experimental example.
Figure 8:
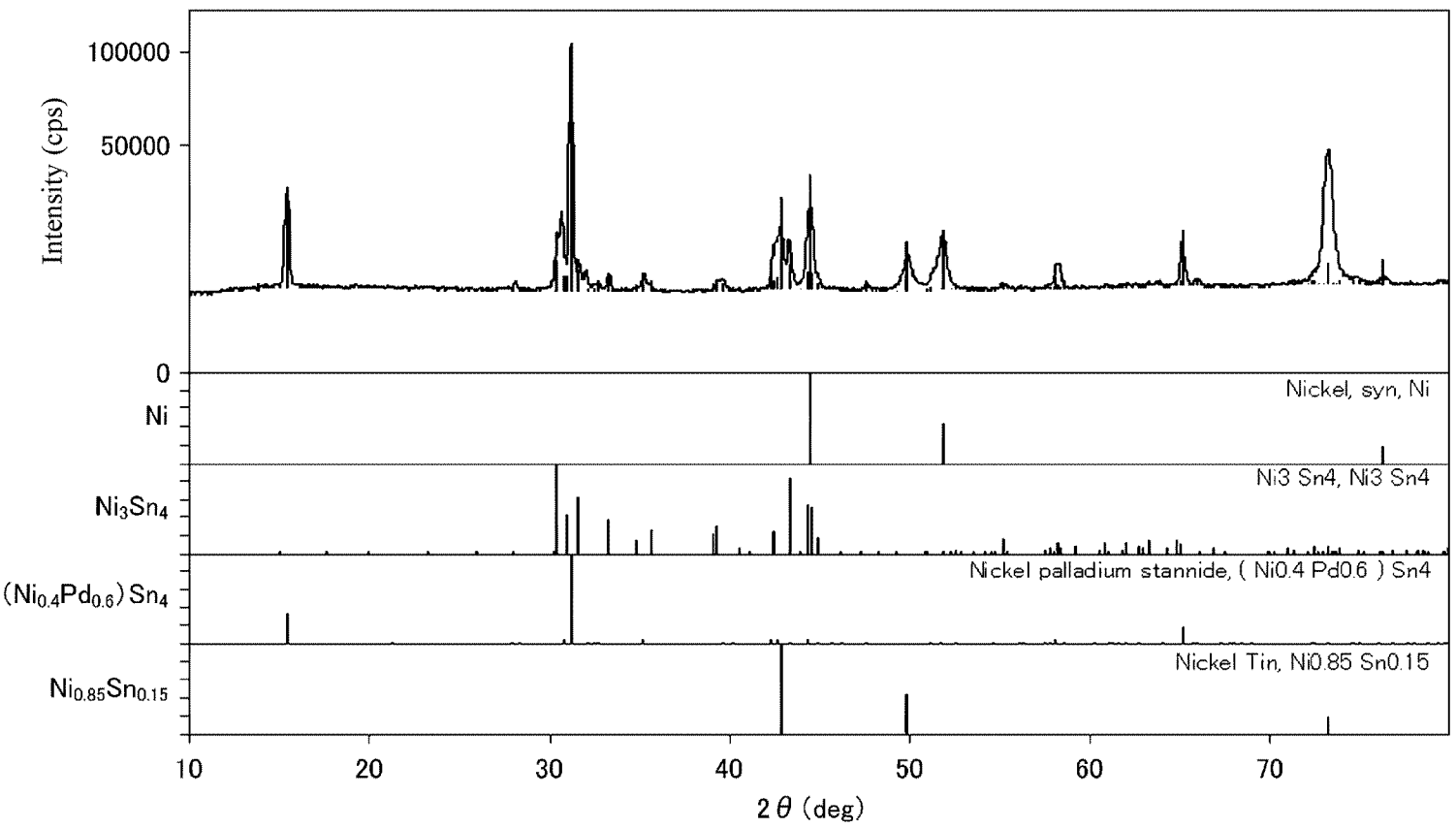
FIG. 8 is a measurement profile that is obtained by XRD analysis of a plating film of Sample 3 that is performed in an experimental example.

FIGS. 6, 7, and 8 respectively show measurement profiles of Sample 1, Sample 2, and Sample 3 that were obtained by the XRD analysis of the plating films. Note that in FIGS. 6 to 8, the uppermost stage shows peaks of the intermetallic compound and metals that are indicated below the uppermost stage, together with measurement data.

As shown in FIGS. 6 to 8, it was confirmed that the particulate materials contained in Samples 1 to 3 are an intermetallic compound that has the composition of $(Ni_{0.4}Pd_{0.6})Sn_4$. Furthermore, the confirmed intermetallic compound has an orthorhombic crystal structure, and its main orientation planes are 040 planes.

Figure 9:
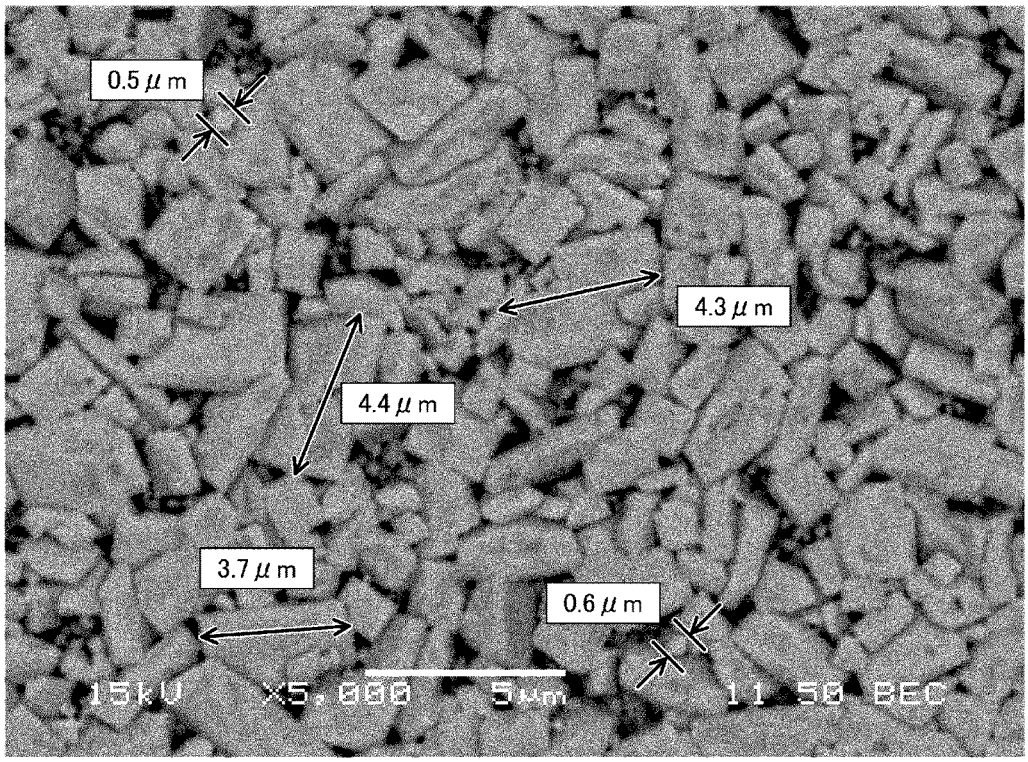
FIG. 9 illustrates a surface image that was captured by a scanning electron microscope after, in an experimental example, the surface of the outermost layer of Sample 2 was etched, and only a Sn parent phase was removed.

Then, the surface (outermost surface of the plating film) of the outermost layer of Sample 2 was etched, and only the Sn parent phase was selectively removed. An aqueous solution obtained by dissolving sodium hydroxide and p-nitrophenol in distillated water was used as an etching solution. Then, the etched surface was observed using the scanning electron microscope at the magnification of 5000×, and one surface image was captured (see FIG. 9). Then, the largest diameters of the individual intermetallic compound particles that have appeared on the obtained surface image were measured. As a result, it was confirmed that the particle diameters of the intermetallic compound were in the range from 0.1 to 10 μm.

Then, similar to Sample 2, surface images of Sample 1 and Sample 3 were obtained. Then, these surface images were subjected to binarization processing based on contrast, and exposed area ratios of the intermetallic compound were respectively calculated based on the obtained binary images. As a result, the exposed area ratio of the intermetallic compound to the outermost surface of the plating film of Sample 1 was 53%, the exposed area ratio with respect to Sample 2 was 73%, and the exposed area ratio with respect to Sample 3 was 90%. Note that a threshold of contrast in the binarization processing was set so that the outline of the intermetallic compound of the binary image substantially conforms to the outline of the intermetallic compound of the surface image.

Furthermore, the thicknesses of the outermost layers of Samples 1 to 3 were respectively 2 μm, 1.6 μm, and 1.2 μm. Furthermore, the thicknesses of the $Ni_3Sn_4$ layers of Samples 1 to 3 were respectively 0.6 μm, 0.6 μm, and 0.5 μm.

Friction Test

A friction test was performed on Sample 2 and Sample 1C in the following manner. Each sample was brought into contact with a hemispherical embossed portion (including a Sn plating film that has a radius of 1 mm, and the thickness of 1 μm) of a counterpart member, and a load of 3 N was applied to them. Then, the hemispherical embossed portion was moved with respect to the sample at a speed of 10 mm/second under application of this load, and the relationships between the moving distances of the hemispherical embossed portion and the kinetic friction coefficients of the samples were measured.

Figure 10:
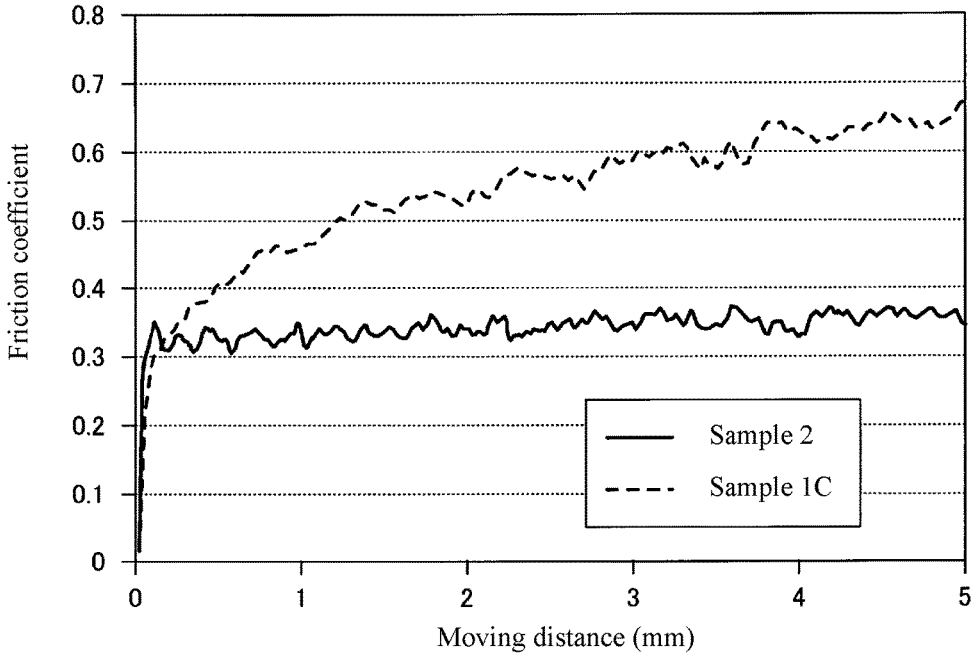
FIG. 10 illustrates measurement results of friction coefficients of Sample 2 and Sample 1C in an experimental example.

FIG. 10 shows the measurement results of the friction coefficients of Sample 2 and Sample 1C. As shown in FIG. 10, it is clear that the plating film of Sample 2 can reduce the friction coefficient of the outermost surface compared to the conventional Sn plating film, and the Sn parent phase is unlikely to adhere or be scratched. This is because the outermost layer of the plating film includes the Sn parent phase, and the intermetallic compound that is dispersed in the Sn parent phase, and is made of Sn, Pd, and Ni, and the intermetallic compound is harder than Sn. This clearly shows that the terminal fitting including this plating film can reduce the terminal insertion force.

Figure 11:
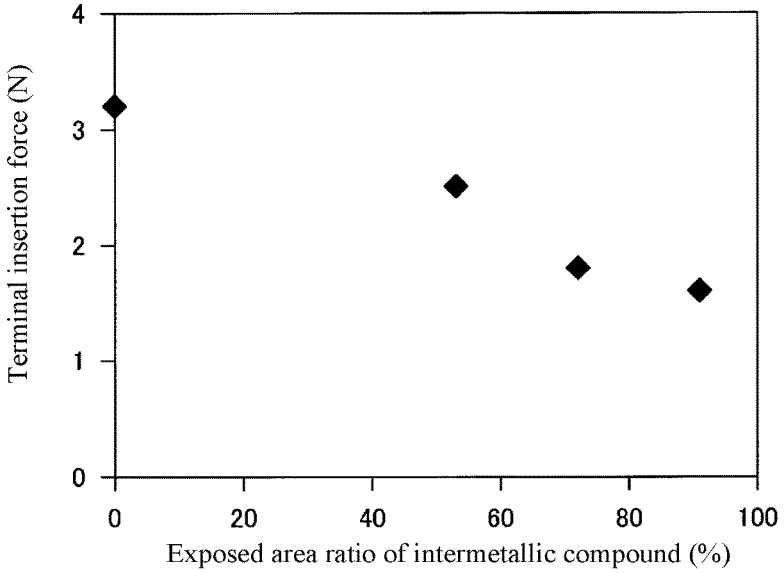
FIG. 11 illustrates a relationship between the exposed area ratio of an intermetallic compound and the terminal insertion force, in an experimental example.

Furthermore, FIG. 11 shows the relationship between the exposed area ratio of the intermetallic compound, and the insertion force. In FIG. 11, terminal fittings that respectively have the plating films of Samples 1 to 3 and Sample 1C were produced, and the terminal insertion forces of Samples 1 to 3 were calculated assuming that the terminal insertion force of Sample 1C that has the conventional Sn plating film is defined as 100%. According to FIG. 11, it is clear that the terminal insertion force can be reduced with an increase in the exposed area ratio of the intermetallic compound. This is because due to the configuration of the plating film, the friction coefficient of the outermost surface of the plating film is largely reduced.

Identification of Element that is Oxidized on Outermost Layer

The samples were exposed to a hot and humid environment of 85° C. and 85% RH for 1000 hours. Then, XPS analysis was performed to identify the element that is oxidized on the outermost layer. The "Quantera SXM" of Ulvac-phi, Incorporated was used as an XPS analysis device. Furthermore, the conditions of the XPS analysis were set as follows: analysis range: 100 μmø; photoelectron takeoff angle: 45° with respect to a sample surface. According to a result of the XPS analysis, Ni and Pd are mainly present as metal from the surfaces of their outermost layers to the inside. In contrast, it was observed that Sn transitioned from SnOx to metal from the surface of its outermost layer to the inside. Based on the result, it is clear that an oxidized film generated on the outermost layer is derived mainly from a Sn oxide.

High Temperature and Humidity Endurance Test

Figure 12:
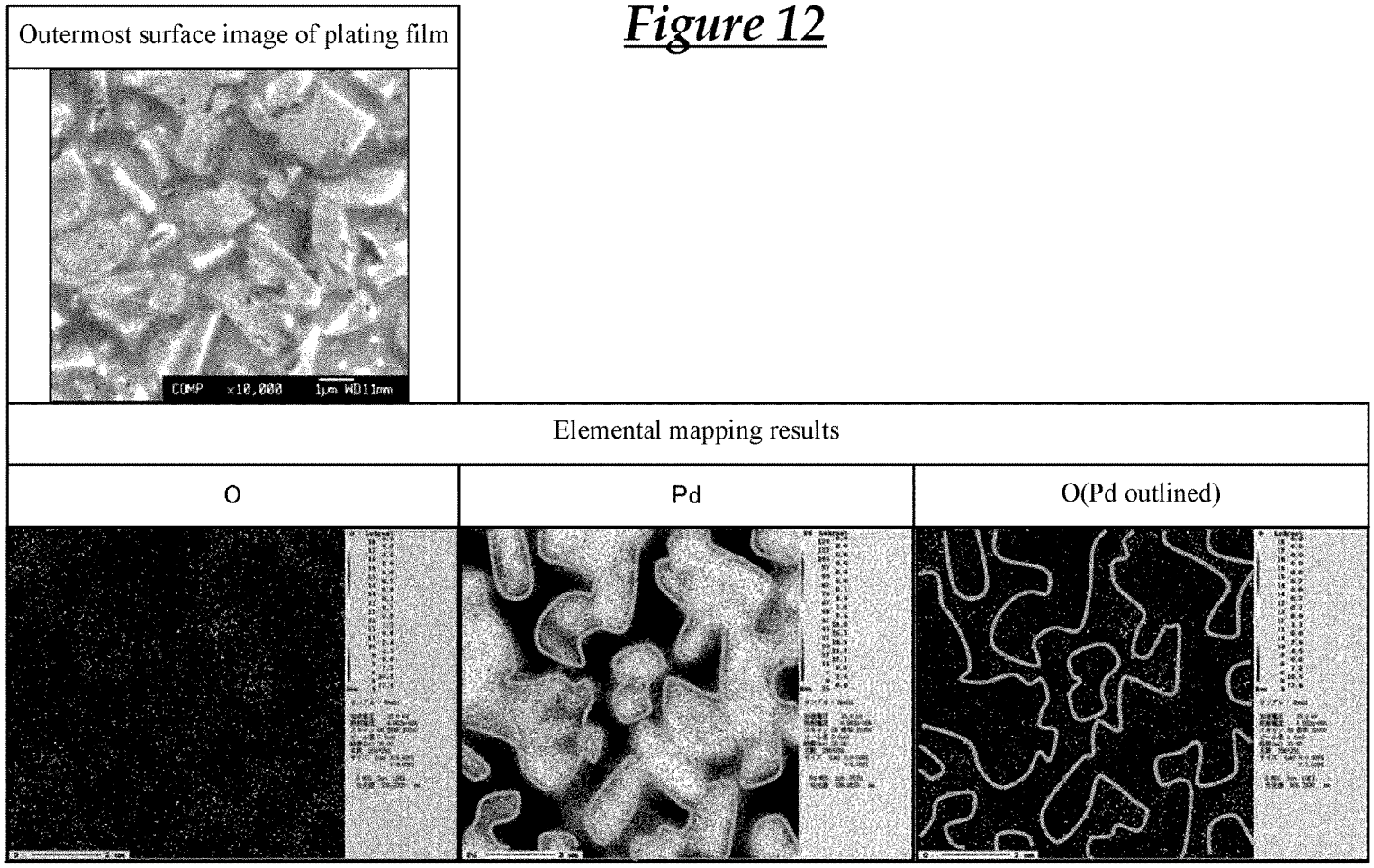
FIG. 12 illustrates elemental mapping results that were obtained by a high temperature and humidity endurance test in an experimental example.

Sample 2 was exposed to a hot and humid environment of 85° C. and 85% RH for 24 hours. Then, EPMA analysis was performed to investigate the film thickness distribution of an oxidized film on the plating film surface. The field-emission electron probe microanalyzer (FE-EPMA) "JXA-8500F" of JEOL was used as an EPMA analysis device. Furthermore, the conditions of the EPMA analysis were set as follows: Imaging method: reflection electron image; Analysis method: Elemental mapping; and Acceleration voltage: 15 kV. FIG. 12 shows results of elemental mapping. According to FIG. 12, it is clear that on the outermost surface of the plating film exposed to the hot and humid environment, the intensity of the element O has increased in the regions in which no Pd element was detected, that is, in the Sn parent phase. On the other hand, an oxidized film of the regions in which a Pd element was detected, that is, the intermetallic compound is a native oxidized film (of about 5 nm), and it was confirmed that an oxidized film is unlikely to grow on the intermetallic compound even if they are exposed to a hot and humid environment. Accordingly, it is clear that, as a result of a Sn parent phase of the outermost layer containing an intermetallic compound made of Sn, Pd, and Ni, it is possible to suppress surface oxidation of a plating film even if it is exposed to a hot and humid environment.

Figure 13:
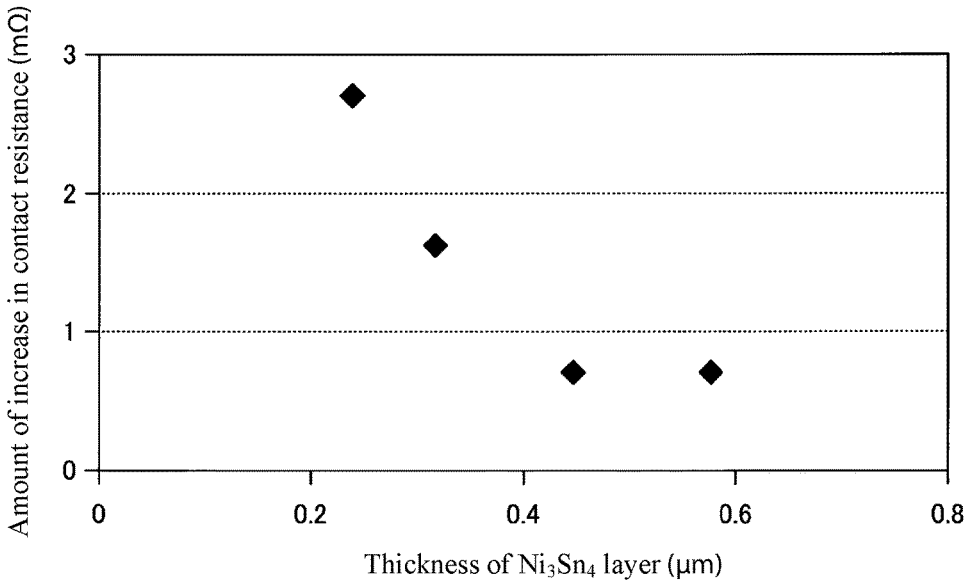
FIG. 13 illustrates a relationship between the thicknesses of $Ni_3Sn_4$ layers of plating films, and increased amounts of the contact resistance of the plating films in an experimental example.

Furthermore, FIG. 13 shows the relationship between the thicknesses of the $Ni_3Sn_4$ layers of the plating films, and the increased amounts of the contact resistances of the plating films. Note that FIG. 13 shows the values obtained in the following manner: a plurality of samples that have substantially the same configuration except for the thicknesses of the $Ni_3Sn_4$ layers were produced with the reflow temperatures adjusted; the contact resistances of the samples were measured in a state in which the surfaces of their plating films were in contact with a gold probe; the contact resistances were measured similarly after the samples were heated at 120° C. for 120 hours; and the amounts of increase (mΩ) in the contact resistance between before and after the thermal endurance process were obtained.

Figure 14:
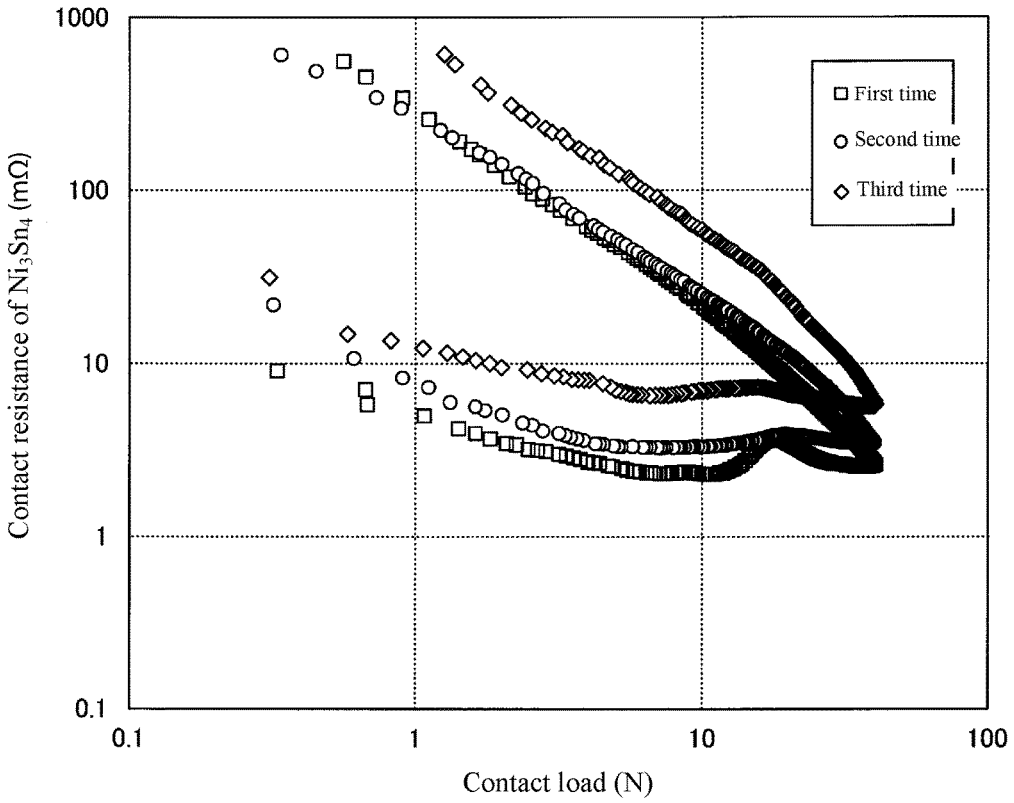
FIG. 14 illustrates a relationship between the contact loads and contact resistances of the $Ni_3Sn_4$ layer alone.

As shown in FIG. 13, it is clear that in a case where the $Ni_3Sn_4$ layer has a thickness of 0.4 μm or more, even if it is exposed especially to a heat environment, it is easy to suppress an increase in the contact resistance that is caused by the Ni component of the Ni foundation layer dispersing toward the outermost surface of the plating film due to the heat. Note that as shown in FIG. 14, the $Ni_3Sn_4$ layer alone has relatively large contact resistance, and tends to have a larger contact resistance with a decrease in a contact load (three measurements were performed). Accordingly, when the terminal fitting has a $Ni_3Sn_4$ layer, it is desirable to adjust the particle diameters of an intermetallic compound, so as to prevent locally grown $Ni_3Sn_4$ from being exposed from the outermost surface of the plating film, and suppress an increase in the contact resistance of the plating film.

The embodiments of the present invention have been described in detail, but the present invention is not limited to the above-described embodiments, and various modifications are possible in a scope without impairing the essence of the present invention.

For example, the terminal fitting 1 may also be mounted on the circuit board 5 directly without being held by the housing 41 of the connector 4. Furthermore, the board connection portion 12 of the terminal fitting 1 may also be pin-shaped so as to form a solder joint. Furthermore, the terminal fitting 1 may also be configured as a fitting-type terminal such as a male-type terminal or a female-type terminal.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A terminal fitting comprising:

a metal base material; and a plating film that covers a surface of the metal base material, wherein the plating film includes a Ni foundation layer that is formed on the surface of the metal base material, an outermost layer that is formed above the Ni foundation layer and is exposed at an outermost surface, and a $Ni_3Sn_4$ layer that is formed between the Ni foundation layer and the outermost layer, the outermost layer includes a Sn parent phase, and an intermetallic compound that is dispersed in the Sn parent phase, and is made of $(Ni_{0.4}Pd_{0.6})Sn_4$, and the intermetallic compound protrudes from a lower side of the outermost layer to the $Ni_3Sn_4$ layer side, and is partially buried in the $Ni_3Sn_4$ layer.

2. The terminal fitting according to claim 1, wherein the $Ni_3Sn_4$ layer has a thickness of at least 0.4 μm.

3. The terminal fitting according to claim 1, wherein the intermetallic compound has a particle diameter in a range from 0.1 to 10 μm.

4. The terminal fitting according to claim 1, wherein the intermetallic compound in the outermost layer is exposed from the outermost surface of the plating film.

5. The terminal fitting according to claim 1, wherein the outermost layer has a thickness in a range from 0.1 to 4 μm.

6. A connector comprising:

the terminal fitting according to claim 1; and a housing that holds the terminal fitting.

* * * * *